US005749767A

United States Patent [19]

Arceo

[11] Patent Number: 5,749,767

[45] Date of Patent: May 12, 1998

[54] PROTECTIVE TIPS FOR BRASSIERE WIRES

[76] Inventor: Kathie Ann Arceo, 2029 S. Hickory, Santa Ana, Calif. 92707

[21] Appl. No.: 771,010

[22] Filed: Dec. 20, 1996

[51] Int. Cl.[6] ..... A41C 3/10; A41C 3/14

[52] U.S. Cl. ..... 450/41; 450/51; 450/52; 450/93; 2/255; 2/256; 2/257; 2/258

[58] Field of Search ..... 2/255, 256, 257, 2/258, 259, 260, 260.1, 261, 262, 263, 264, 73; 450/41, 42, 43, 44, 45, 46, 47, 48, 49, 50, 51, 52, 53, 93

[56] References Cited

U.S. PATENT DOCUMENTS 2,912,983 11/1959 Horn ..... 450/48

3,033,205 5/1962 Walters ..... 450/48

3,884,244 5/1975 Rowell ..... 450/52

*Primary Examiner*—Jeanette E. Chapman

[57] ABSTRACT

Protective tips for brassiere wires including a brasserie with a pair of cups. An elongated wire extends along a bottom periphery of each cup. A pair of T-shaped tips are each integrally positioned on an associated wire. Preferably, the wires and T-shaped member is lined with a material in a group which includes TEFLON.

1 Claim, 2 Drawing Sheets

PROTECTIVE TIPS FOR BRASSIERE WIRES

BACKGROUND OF THE INVENTION

1. Field of the Invention

The present invention relates to protective tips for brassiere wires and more particularly pertains to increasing the longevity of a brassiere and further providing comfort to the user by conforming to the shape of the user's body.

2. Description of the Prior Art

The use of brassiere wires is known in the prior art. More specifically, brassiere wires heretofore devised and utilized for the purpose of reinforcing brassieres are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,201,220 to Rowell; U.S. Pat. No. 4,133,316 to Schwartz; U.S. Pat. No. 4,306,565 to Rowell; U.S. Pat. No. 5,219,311 to Fildan; U.S. Pat. No. 4,235,240 to Cousins; and U.S. Pat. No. 4,275,740 to Weston.

In this respect, the protective tips for brassiere wires according to the present invention substantially departs from the conventional concepts and designs of the prior art, and in so doing provides an apparatus primarily developed for the purpose of increasing the longevity of a brassiere and further providing comfort to the user by conforming to the shape of the user's body.

Therefore, it can be appreciated that there exists a continuing need for a new and improved protective tips for brassiere wires which can be used for increasing the longevity of a brassiere and further providing comfort to the user by conforming to the shape of the user's body. In this regard, the present invention substantially fulfills this need.

SUMMARY OF THE INVENTION

In view of the foregoing disadvantages inherent in the known types of brassiere wires now present in the prior art, the present invention provides an improved protective tips for brassiere wires. As such, the general purpose of the present invention, which will be described subsequently in greater detail, is to provide a new and improved protective tips for brassiere wires which has all the advantages of the prior art and none of the disadvantages.

To attain this, the present invention essentially comprises a pair of opposed cups coupled by a connecting member. As shown in FIGS. 1–2, a torso strap is coupled to sides of the cups opposite the connecting cloth. As best shown in FIG. 1, an upper edge of the torso strap and a periphery of the cups adjacent thereto form a concave arcuate continuous edge. A pair of shoulder straps are coupled between an upper extent of each cup and the torso strap. It should be noted that the above mentioned concave arcuate continuous edge terminates at the strap. Further provided is a closed sleeve formed along the lower periphery of each cup between an upper edge of the connecting member and the interconnection of the upper edge of the torso strap and respective cup. Also included is an elongated wire situated within the sleeve and extending along the entire length thereof. As shown in FIGS. 3–4, a pair of T-shaped tips are included. Each T-shaped tip includes an arcuate member integrally coupled at a central extent thereof to an end of a respective wire. Finally, a pair of cylindrical tips are integrally coupled to each wire opposite the respective T-shaped tip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective tips for brassiere wires which has all the advantages of the prior art brassiere wires and none of the disadvantages.

It is another object of the present invention to provide a new and improved protective tips for brassiere wires which may be easily and efficiently manufactured and marketed.

It is a further object of the present invention to provide a new and improved protective tips for brassiere wires which is of a durable and reliable construction.

An even further object of the present invention is to provide a new and improved protective tips for brassiere wires which is susceptible of a low cost of manufacture with regard to both materials and labor, and which accordingly is then susceptible of low prices of sale to the consuming public, thereby making such protective tips for brassiere wires economically available to the buying public.

Still yet another object of the present invention is to provide a new and improved protective tips for brassiere wires which provides in the apparatuses and methods of the prior art some of the advantages thereof, while simultaneously overcoming some of the disadvantages normally associated therewith.

Still another object of the present invention is to increase the longevity of a brassiere and further provide comfort to the user by conforming to the shape of the user's body.

Lastly, it is an object of the present invention to provide new and improved protective tips for brassiere wires including a brasserie with a pair of cups. An elongated wire extends along a bottom periphery of each cup. A pair of T-shaped tips are each integrally positioned on an associated wire. Preferably, the wires and T-shaped member is lined with a material in a group which includes TEFLON.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
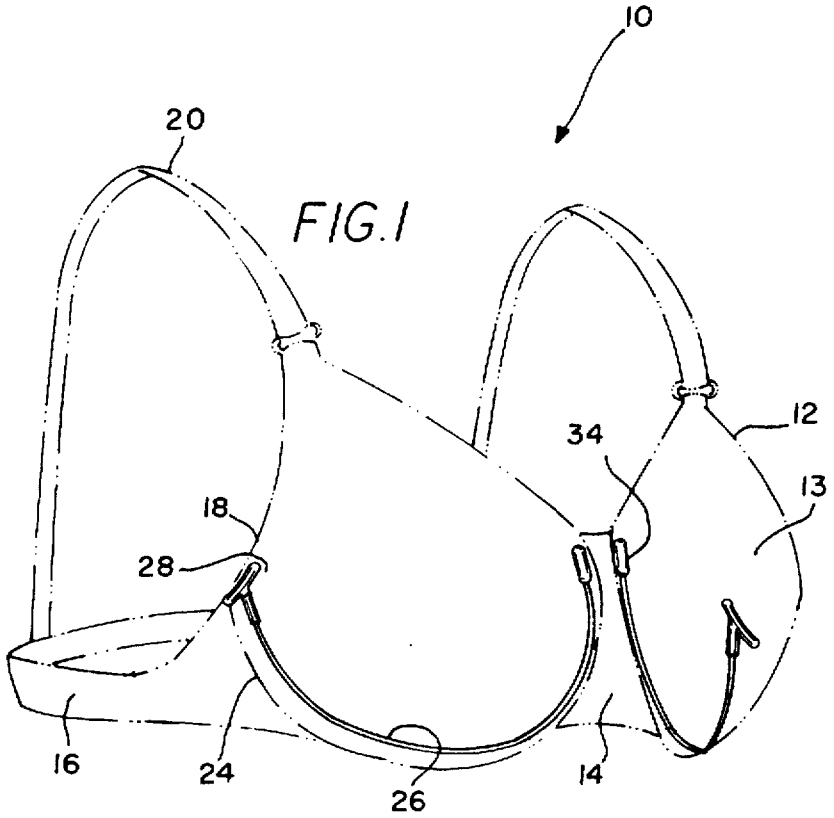
FIG. 1 is a perspective illustration of the preferred embodiment of the protective tips for brassiere wires constructed in accordance with the principles of the present invention.

With reference now to the drawings, and in particular to FIG. 1 thereof, a new and improved protective tips for brassiere wires embodying the principles and concepts of the present invention and generally designated by the reference numeral 10 will be described.

The present invention, the new and improved protective tips for brassiere wires, is comprised of a plurality of components. Such components in their broadest context include a brassier, a pair of wires, a pair of T-shaped tips, and a pair of cylindrical tips. Such components are individually configured and correlated with respect to each other so as to attain the desired objective.

Figure 2:
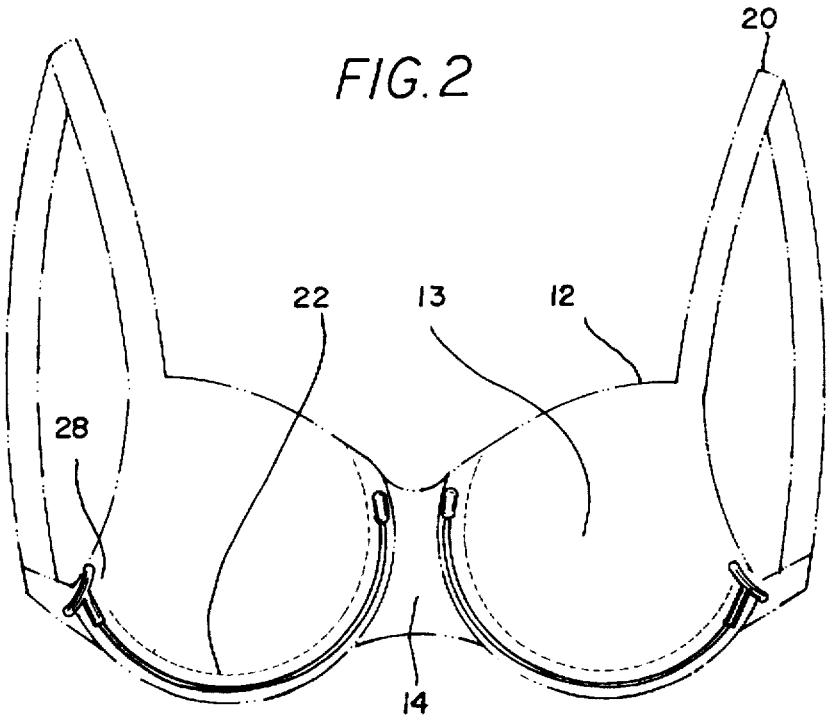
FIG. 2 is a front elevational view of the present invention.

More specifically, it will be noted that the system 10 of the present invention includes a brassiere 12 having a pair of opposed cups coupled by a connecting member 14. As shown in FIGS. 1–2, a torso strap 16 is coupled to sides of the cups opposite the connecting cloth. As best shown in FIG. 1, an upper edge of the torso strap and a periphery of the cups adjacent thereto form a concave arcuate continuous edge 18. A pair of shoulder straps 20 are coupled between an upper extent of each cup and the torso strap. It should be noted that the above mentioned concave arcuate continuous edge does not extend on the cup past the straps 20. Further provided is a closed sleeve 22 formed along the lower periphery of each cup between an upper edge of the connecting member and the interconnection 24 of the upper edge of the torso strap and respective cup.

Figure 3:
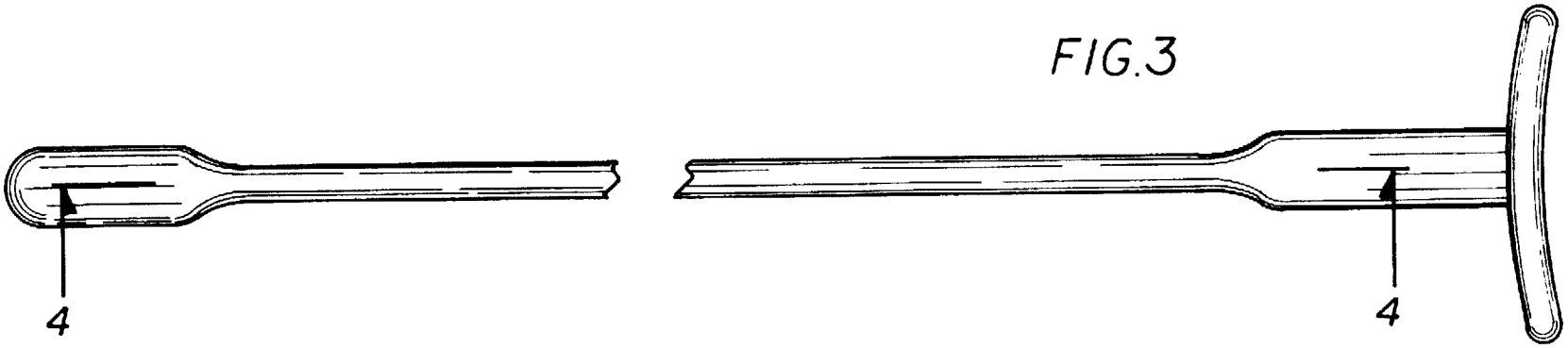
FIG. 3 is a plan view of the wire and associated tips according to the present invention.
Figure 4:
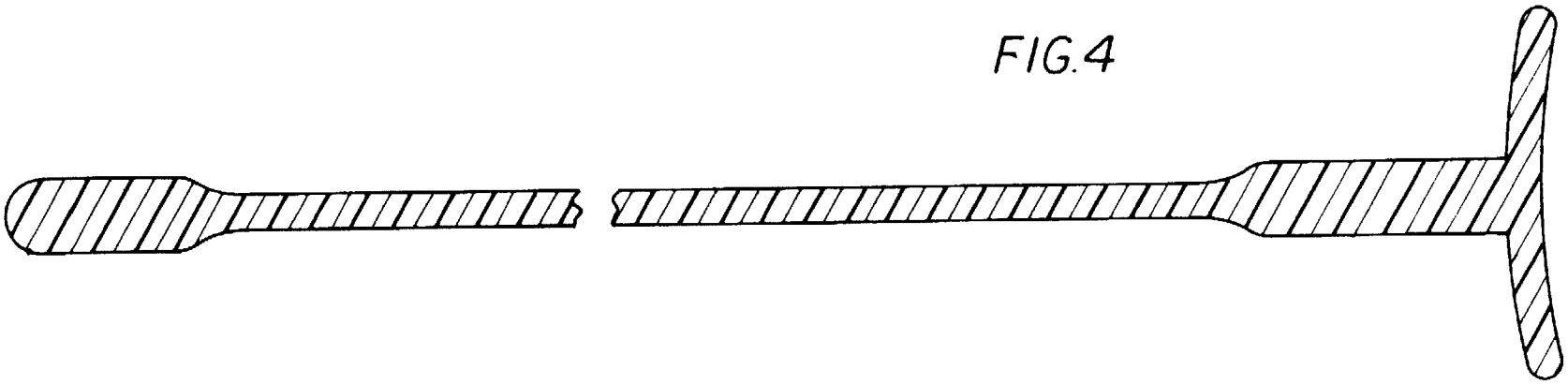
FIG. 4 is a cross-sectional view of the present invention taken along line 4—4 depicted in FIG. 3.

Also included is an elongated metal wire 26 situated within the sleeve and extending along the entire length thereof. As shown in FIGS. 3–4, the wires are initially linear but are arcuate in form upon insertion within the sleeves.

As shown in FIGS. 3–4, a pair of T-shaped tips 28 are included. Each T-shaped tip includes a cylinder 30 and an arcuate member 32 which is integrally coupled at a central extent thereof to an end of the cylinder. As shown in FIG. 4, the cylinder has a diameter greater than the wire. Ideally, the arcuate member is approximately 1 inch in length and extends ½ an inch from either side of the cylinder. As shown in the Figures, the cylinders of the T-shaped members are each integrally coupled to an end of a respective wire, wherein the arcuate member thereof resides coincident with the concave arcuate edge of a respective cup. Such integral coupling is critical to preclude chipping and inadvertent removal of the tip if it were merely secured on the wire.

As shown in FIGS. 1 and 2, the arcuate member is maintained in the proper orientation thereof via a seam 33.

Such seam substantially encompasses the arcuate member. It should be further noted that the degree of curvature of the arcuate member depends on the arcuate edge of the respective cup.

Finally, a pair of cylindrical tips 34 are provided. Each cylindrical tip is formed of a cylinder which has a diameter greater than the wire, as shown in FIG. 4. The cylindrical tips are integrally coupled on an end of each wire opposite the respective T-shaped tip. It should be noted that the ends of all the tips are curved such that no sharp edges exist. Further, all of the tips are coated with TEFLON in order to reduce friction with the brasserie.

In use, the tips preclude the user from being lacerated by the wire and further increase the longevity of the sleeve and brassiere. In addition, the T-shaped tip provides comfort to the user by conforming to the shape of the user's body.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Protective tips for brassiere wires comprising, in combination:

a brassiere having a pair of opposed cups coupled by a connecting member, a torso strap coupled to sides of the cups opposite the connecting cloth wherein an upper edge of the torso strap and a periphery of the cups adjacent thereto form a concave arcuate continuous edge, a pair of shoulder straps coupled between an upper extent of each cup and the torso strap, a closed sleeve formed along the periphery of each cup between an upper edge of the connecting member and the interconnection of the upper edge of the torso strap and respective cup;

an elongated wire situated within the sleeve and extending along the entire length thereof;

a pair of T-shaped tips each including a cylinder and an arcuate member integrally coupled at a central extent thereof to the cylinder, whereby one of the cylinders of the T-shaped members is integrally coupled to an end of each wire, wherein each arcuate member resides coincident with the concave edge of a respective cup;

said arcuate member being approximately 1 inch in length and extending about ½ an inch from either side of the cylinder of the associated T-shaped tips;

a seam formed in the brasserie which encompasses each arcuate member; and a pair of cylindrical tips each including a cylinder, whereby one of the cylindrical tips is integrally coupled to an end of each wire opposite the respective T-shaped tip;

said cylinders having a diameter greater than that of the wire;

said tips being coated with polytetrafluroethylene.

* * * * *